United States Patent [19]

Wirth

[11] 4,286,757

[45] Sep. 1, 1981

[54] METHOD AND APPARATUS FOR CONTROLLING THE BRAKING SYSTEM FOR AN UNWINDER

[75] Inventor: Hans Wirth, Baldwinsville, N.Y.

[73] Assignee: The Black Clawson Company, Fulton, N.Y.

[21] Appl. No.: 137,041

[22] Filed: Apr. 3, 1980

[51] Int. Cl.[3] ..... B65H 25/22

[52] U.S. Cl. ..... 242/75.44

[58] Field of Search ..... 242/75.42, 75.4, 75.43, 242/75.44, 75.45, 75.5

[56] References Cited

U.S. PATENT DOCUMENTS

| | | | |
|---|---|---|---|
| 2,974,893 | 3/1961 | Aaron | 242/75.43 |
| 2,974,894 | 3/1961 | Aaron | 242/75.43 |
| 3,057,574 | 10/1962 | Justus | 242/75.43 |
| 4,199,118 | 4/1980 | Tetro | 242/75.44 |

*Primary Examiner*—Edward J. McCarthy

*Attorney, Agent, or Firm*—Biebel, French & Nauman

[57] ABSTRACT

A brake control system for an unwinder measures the line speed of the moving web and the rpm of the roll and produces electrical output signals proportional to each, which signals are operated upon to produce a main brake control signal to apply a braking force proportional to the roll diameter as it is constantly decreasing, and a further output signal which is proportional to the energy in the roll based on the calculation of the cube of the diameter of the roll so that required braking force modification will occur during acceleration and deceleration of the web in order to maintain essentially constant web tension. An additional feedback from a web tension measuring device is also provided which adjusts the braking force to produce an actual tension equal to the desired tension which has been included in the main braking force output signal proportional to the roll diameter.

5 Claims, 1 Drawing Figure

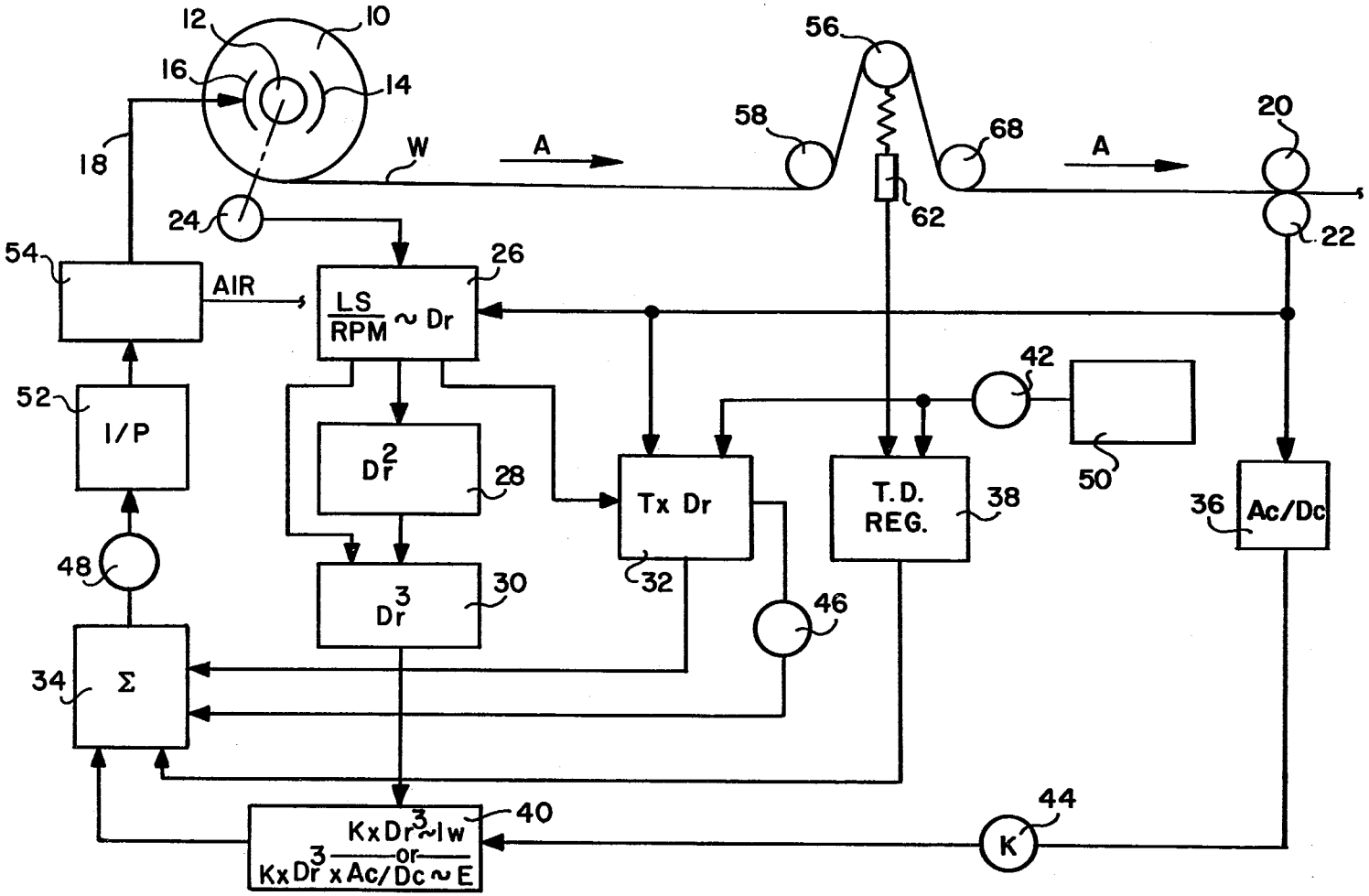
Ac/Dc
T.D. REG.
Tx Dr
LS/RPM ~ Dr
Dr²
Dr³
Kx Dr³~|w
or
Kx Dr³ x Ac/Dc ~ E
I/P
Σ
AIR
K
A
W

METHOD AND APPARATUS FOR CONTROLLING THE BRAKING SYSTEM FOR AN UNWINDER

CROSS REFERENCE TO RELATED APPLICATION

This application is related to application Ser. No. 2,405, filed Jan. 10, 1979, now U.S. Pat. No. 4,199,118.

BACKGROUND OF THE INVENTION

1. Field of the Invention

The present invention relates to a braking system for an unwinder of rolls of web material, and more particularly, to a braking system which maintains uniform tension on the web material downstream of the unwinding device as a roll of web material is unwound.

2. Prior Art

In unwinding devices such as those employed in the paper industry for unwinding large rolls of paper web, it is generally necessary to apply some degree of braking force to the roll of web as it is being unwound, in order to maintain a uniform tension on the web for processing through various types of paper processing machinery downstream of the unwinding apparatus. Some of the rolls of paper which are so processed are fairly large in diameter, for example, one hundred inches. This size of roll possesses fairly large inertia when it is rotated at the high rotational speeds necessary to achieve the high line speeds for processing of web material in modern equipment.

Since there are numerous occasions upon which the speed of the roll being unwound is either increased or decreased, the braking forces applied to the roll must be adjustable in order to compensate for the inertia of the roll so as to maintain uniform tension in the web and prevent breakage of the web or reductions in tension. As the roll diameter decreases during the unwinding process, the inertia of the roll likewise decreases, and the braking forces required to maintain uniform tension should also be modified accordingly.

In less sophisticated prior art systems, the braking force is adjusted manually by the operator maintaining vigilence over a tension measuring device which constantly monitors the tension on the web downstream from the unwinder and indicates to the operator whether or not the tension is as desired. Such a system obviously has several drawbacks, particularly since the reaction time of the operator may not be sufficiently rapid to prevent breakage of the web should the tension increase rapidly for any reason. Also, it requires the operator to maintain constant vigilence over the tension and make multiple adjustments in the braking force as the roll diameter of the roll of web material being unwound decreases.

A more suitable prior art system utilizes a tension measuring device which provides continuous feedback to the braking system for automatic adjustment of the braking force when the tension in the web changes from the desired level. Such systems utilize the feedback signal to control the tension throughout the unwinding of the roll as well as for correcting for tension upsets which occur in the system. Since such systems do not take into account the roll diameter, they must constantly increase or decrease the braking force applied to the roll until the proper tension level is reached.

The problem with this type of system is that it does not take into account changes in roll diameter during application of the braking force. Thus, a predetermined average braking force is usually programmed into the system, and this braking force is too large to be applied to a roll which is almost completely unwound, and too small to be applied to a new roll. With such systems, particularly when a roll has been substantially decreased from the nominal diameter used to establish the braking force, where almost instantaneous tension changes occur, a rapid change in braking force would occur which could cause either braking of the web if the braking force is greatly increased, or loss in tension due to a rapid releaving of the braking force.

In an attempt to solve the difficulties with the direct tension measuring feedback circuit, a system was developed which calculates the roll diameter continuously and applies proportional braking force to the roll to maintain a predetermined tension in the web. This is accomplished by measuring the line speed and the rpm of the roll of web material and then dividing the line speed by the rpm to determine the radius or diameter of the roll at that instant. The braking force is then proportioned for the given roll diameter by introducing a constant multiplier factor established by the operator for a desired web tension. The arbitrary constant is introduced by the operator into the braking force system by manual settings and is intended to compensate for the inertia of the roll. However, as the roll diameter decreases, the actual inertia of the roll will change, and thus the constant will not be accurate for the entire range of roll diameters as the roll is unwinding. Thus, with this system, some variation in tension will occur due to the difference between the actual inertia of the roll and the calculated braking force based on the arbitrary constant intended to represent the roll inertia.

In the related case referred to above, a system is provided which measures the line speed of the moving web and the rpm of the roll of web material and produces an electrical output signal which is used to control the braking force applied to the roll, as the main course adjustment for the braking force, and in addition, provides additional input signals based on sensing of acceleration and deceleration of the roll as well as fluctuations in web tension. That device develops a signal which is proportional to the square of the diameter of the roll and although the device functions satisfactorily, it has been discovered that the utilization of a signal proportional to the square of the roll diameter is not as accurate an indicator of the inertia or energy of the roll as is desired.

SUMMARY OF THE INVENTION

The present invention overcomes the above described difficulties and disadvantages associated with such prior art devices by providing a brake control mechanism for a web unwinding apparatus which takes into account the roll diameter and continuously calculates the inertia and energy of the roll based on the calculation of the cube of the diameter which is a more accurate determination of inertia and energy of the role than is provided by the previously described systems. This provides an accurate feedback to the brake mechanism so that an accurate amount of braking force is applied to the roll to compensate directly for the inertia of the roll and thus maintain an accurate tension control downstream of the unwinding device. In addition, the present invention provides a further input in the form of actual measured tension downstream of the roll, which is used to compensate for any difference which may occur between the actual tension in the web and the desired tension determined by the primary brake control system.

The present system measures both the rpm of the roll of web material being unwound and the line speed of the web, with tachometer-generators which generate signals proportional to the rpm and line speed. The line speed output signal is divided by the rpm output signal, and the result is a signal proportional to the roll diameter.

This diameter signal is then operated upon by a series of potentiometer and amplifier controlled circuits. One of the potentiometer circuits permits the desired tension in the web to be introduced by operator adjustment so that the output signal is modified accordingly. These circuits also establish the operating range of the braking force and thus the range of tension which can be established in the web and also provide for the rate at which braking forces can be increased or decreased in order to prevent either breakage of the web or loss of tension due to rapid changes in conditions. A further adjustment on the output signal is provided to introduce a stall or minimum tension which is useful in preventing the roll of material from unwinding when the line is shut down since otherwise zero braking force might be applied to the roll.

The output signal from the scaling amplifier and potentiometer circuit is then fed to an air brake control system in the form of a current-to-pressure converter which converts the electrical input signal representing the desired tension in the web at the present roll diameter, into an air pressure output signal proportional to the braking force necessary to obtain the desired tension. The output air pressure of the current-to-pressure converter is then preferably fed to an air rate multiplier which directly controls an air brake associated with the support spindle for the roll of material being unwound, and applies the correct amount of braking force to obtain the desired tension.

The signal representing the roll diameter is also received in another part of the control circuitry where it is modified in turn to represent the cube of the diameter and then combined with an operator adjusted input constant representing the density of the web material multiplied by the width of the roll of web. The resulting output signal is then proportional to the inertia in the roll.

The line speed measuring device, such as a tachometer-generator, is used to produce a signal which represents acceleration or deceleration in the web line speed. This signal is then combined with the signal representing the inertia in order to produce a further output signal proportional to the energy in the roll. This output signal is then added to the main web tension signal, discussed above, and introduced into the current to pressure converter to further change the braking force to compensate for the energy in the roll as the line speed is increasing or decreasing.

With these two signals, i.e. the main desired web tension signal and the energy signal, being utilized to control the current-to-pressure converter and thus the pressure applied to the air brake, substantially all of the control essential to operation of the device is provided. However, in order to obtain an even finer adjustment to establish more accurately the desired web tension, it is also contemplated that a web tension measuring device can be provided to introduce a further feedback to the system. Such a web tension measuring device, for example, a simple linear transducer supported by a dancer roll, can be positioned in contact with the web downstream from the roll of web material and produces an output signal which can be added to the main desired web tension signal and the signal proportional to the energy in the roll if the measured tension is other than the desired web tension so that further adjustment of the braking force can be obtained.

In addition, it is contemplated that an antihunt feature be associated with the tension measuring device in order to prevent the constant addition and subtraction of a braking force to the roll due to very small fluctuations in the difference between the measured tension and the desired web tension introduced through the roll diameter calculations. This device simply provides a tension trim regulator to improve tension control of the basic system.

BRIEF DESCRIPTION OF THE DRAWINGS

The FIGURE is a schematic illustration of the system of the present invention applied to an unwinding roll of web material.

DETAILED DESCRIPTION OF THE PREFERRED EMBODIMENT

The system of the present invention can be utilized in connection with any operation where a roll of web material is being unwound, where it is important to maintain substantially uniform tension on the web during the unwinding sequence. However, the present system will be described in the context of paper unwinding equipment which is the area of its intended primary utilization.

As illustrated in the FIGURE, a roll of paper 10 is supported at its core by a spindle 12 which is mounted at its ends for rotation in an unwinding device (not shown) of the type commonly used in the paper processing industry. Associated with the spindle at one or both ends thereof are friction braking pads 14 and 16 which engage the spindle surface in order to apply braking force to the roll of material being unwound.

The air brake is schematically shown in the FIGURE as comprised of the two friction shoes 14 and 16 supplied with air through air line 18 to cause engagement of the friction shoes with opposing sides of the cylinder supporting the roll 10. Such braking mechanisms can be applied to either one or both sides of the roll as is desired. The web W which is being unrolled in the FIGURE in the direction of arrow A passes through a pair of rollers 20 and 22, the latter of which is associated with or contains a tachometer-generator of conventional construction, or other device, which produces an electrical output signal proportional to the line speed of the moving web.

A further tachometer-generator 24 is associated with the spindle 12 and produces an electrical output signal proportional to the rpm of the rotating roll 10.

The outputs from both tachometer-generators 22 and 24 are fed to a computing device 26 such as a digital processor or analog circuit which can perform a division calculation continuously as it receives the signals from the speed reference and tachometer-generator 24. The computing device 26 divides the signal proportional to the line speed by the signal proportional to the rpm to produce in turn an output signal proportional to the roll diameter $D_r$ of the unwinding roll of web material 10. This output signal is then passed through several multiplying circuits represented schematically in the FIGURE by members 28, 30 and 32.

The output signals of these multiplying circuits are then combined with scaling circuits and adjustable potentiometers to produce desired output signals to the given factors which they each control, as is explained in detail below. Scaling circuits and potentiometers are represented in the FIGURE by members 32, 34, 36, 38, 40, and 42, 44, 46, respectively. It is to be understood that other electrical components are associated with each circuit to effect desired modifications of the input signals. However, since such circuitry is conventional and well known, the details thereof will not be discussed.

The potentiometer control circuit 42 receives a precise reference signal from a regulated reference 50. The output of this potentiometer control circuit is then multiplied by the diameter of the unwinding roll through multiplying circuit 32, producing an output signal of desired tension in the web. A potentiometer is provided in this circuit to permit the operator to adjust the desired web tension manually. This circuit establishes the main or coarse signal for producing a braking force proportional to the roll diameter. The potentiometer control and multiplying circuit 32 and 42 is calibrated to produce an output signal that will result in an appropriate braking force being applied to the spindle 12 by the shoes 14 and 16 as the roll diameter continually decreases. Thus it can be seen that as the roll diameter decreases, the braking force applied to the roll 10 will decrease in direct proportion and thus maintain substantially uniform web tension at the desired level.

A second potentiometer control circuit 46 allows for a minimum setting of the braking force required at standstill condition of the roll 10. This control circuit also provides an operator adjustable potentiometer to provide desired presetting for stall tension. Multiplying and combining circuit 32 also receives an input from the web speed signal generator 22 which allows for transferring the desired preset web tension from the stall tension circuit 46 to the running tension potentiometer circuit 42. When the machine is decelerated to zero, the same circuit 32 again will transfer the web tension control from circuit 42 to circuit 46.

The desired tension output signal from circuit 32 is then directed to a summing amplifier circuit 34. The output of the summing amplifier circuit 34 connects through a potentiometer control circuit 48 to the input of the current-to-pressure converter 52.

The potentiometer control circuit 48 allows for proper scaling of the signal input for the current-to-pressure converter and also provides for a minimum input at the low level. As a lower limit on the minimum tension set by this circuit, the current-to-pressure converter characteristics must be taken into account. Such current-to-pressure converters generally do not operate down to a zero pressure output level and require some current input in order to be operative. Thus, the minimum tension setting can be established through the adjustment of potentiometer control circuit 48 and is generally equal to the lower operating level of the current-to-pressure converter since no control of the converter would exist below that minimum setting. As is discussed in more detail below, however, the pressure output from the current-to-pressure converter can be adjusted to provide any range of pressure from zero up to any desired maximum pressure level.

The output signal from the last potentiometer control circuit 48 is provided as the input to the above referred current-to-pressure converter 52. The current-to-pressure converter 52 produces an output air pressure proportional to the current input from the potentiometer control circuit 48, which is in turn proportional to roll diameter, as discussed above. This pressure output from the current-to-pressure converter 52 is then either used to control directly the braking force applied to the roll 10 or, if conditions require, is passed through an air rate multiplier 54 which provides a greater pressure range than is available direct from the current-to-pressure converter 52.

The output of the rate multiplier 54 is then, in turn, used to apply the braking force through brake shoes 14 and 16 to spindle 12. The air pressure which is applied to this brake control is predetermined to be at the level necessary to give the desired tension in web W. It can be seen that as the roll diameter calculation signal decreases, the braking force applied will likewise decrease thus maintaining uniform tension in the web W.

The above described circuits provide the main or coarse adjustment for controlling the braking force in order to maintain desired web tension. However, as mentioned above in connection with the prior art, this is not sufficiently satisfactory for maintaining the accuracy required in some paper-processing systems. Therefore, a further adjustment is provided which takes into account the energy contained in the rotating roll 10 and adjusts the braking force to compensate for acceleration and deceleration during the transient conditions of operation of the paper processing equipment.

To accomplish this, the output signal from the roll diameter computing device 26 is introduced into a further computing device 28, similar to device 25 described above, and which produces an output signal proportional to the square of the roll diameter and essentially performs the function of multiplying the roll diameter input signal by itself to obtain the square of the diameter. The output signal of computing device 28 and the output of computing device 26 are further introduced into a computing device 30. Computing device 30 multiplies the roll diameter which is the output from computing device 26 and roll diameter squared which is the output from computing device 28 and produces an output signal proportional to the cube of the roll diameter 10.

The output signal of the computing device 30 is received by a similar computing device 40. Device 40 is utilized to produce an output signal proportional to the inertia of the roll. As a variable control of the output signal from device 40, an amplifier and potentiometer scaling circuit 44 is provided. This scaling circuit contains an operator set potentiometer which is used to calibrate the input to device 40 to provide introduction of a constant K equivalent to the roll density of the material being unwound from roll 10 times the width of the roll. This constant K is in effect multiplied by the roll diameter cubed in device 40 to produce an output signal from this device proportional to the inertia $I_w$ of the roll. The input signal to scaling circuit 44 is provided by a computing device 36 which in turn receives a signal from the line speed tachometer generator 22. This latter signal is first passed through a circuit represented by member 36 which determines whether or not the web is accelerating or decelerating or remains at a constant speed. If the speed is constant, there is no output signal from device 36, but, if there is acceleration or deceleration, a signal proportional to the acceleration or deceleration is received in the computing device 40 through scaling circuit 44.

Device 40 then produces an output signal proportional to the energy E in the roll by essentially combining the input signals thereto so as to amount to the calculation of the energy by multiplying the inertia by either the acceleration or deceleration. The output signal from device 40 is then combined by the summing circuit 34 with the output signal from the potentiometer control circuit 32, and thus modifies the current input to the current-to-pressure converter 52 which in turn modifies the braking force applied to the roll 10 in order to compensate for the energy in the roll during either acceleration or deceleration.

In those situations where an even more exact control over the tension in the web is necessary, both in the steady-state condition where the line speed of the web is constant as well as during acceleration and deceleration of the web, a further circuit is provided in the present invention which makes a comparison between the actual web tension of the moving web and the present web tension produced by the above signal inputs, and further adjusts the signal inputs so that the measured tension corresponds more precisely to the desired tension level. This is accomplished through a dancer roll 56 which engages the web downstream of the roll 10 being unwound, but upstream from the web speed measuring rolls 20 and 22.

Dancer roll 56 is resiliently supported and biases a portion of web W upward between two guide rolls 58 and 68. A linear transducer 62 is engaged with dancer roll 56 so that vertical movement of the dancer roll, as illustrated in the FIGURE, will cause a signal output from the transducer 62 which is proportional to the tension in the web. This signal provides the feedback level to the high gain tension regulator circuit 38. The reference level connected to the tension circuit regulator 38 is obtained from the tension level set control circuit 42. The output signal from tension regulator circuit 38 further modifies the input signal to the current-to-pressure converter 52 through summing amplifier 34. This closed loop tension regulator receives the desired reference level from the potentiometer control circuit 42 through the operator set tension potentiometer. Whenever the feedback level from the force transducer 62 is above or below the desired reference level, the output signal from tension regulator circuit 38 will correct the input signal to the current-to-pressure converter 40 to adjust the force supplied to the braking mechanism and in turn adjusts the tension in the web in order to bring the tension closer to the desired level.

The tension regulator circuit 38 is provided with an anti-hunt adjust potentiometer to dampen erratic signals caused by possible mechanical vibrations or operating transients in order to produce a stable control loop.

Although the foregoing illustrates the preferred embodiment of the present invention, other variations are possible. All such variations as would be obvious to one skilled in this art are intended to be included within the scope of the invention as defined by the following claims.

What is claimed is:

1. In an apparatus for controlling a braking action of a roll of web material supported for rotation on an unwinding device including:

means for continuously measuring line speed and rate of change thereof of said web downstream of said unwinding device and providing an output signal proportional to said line speed, means for continuously measuring rotational speed of said roll of web and providing an output signal proportional to said rotational speed, means receiving said output signals from said line speed and rotational speed measuring means and combining said signals to produce an output signal proportional to the diameter of said roll, means receiving said output signal proportional to said roll diameter and producing an output signal proportional to a predetermined desired web tension downstream of said roll, means receiving said output signal proportional to said line speed and producing an output signal proportional to the acceleration or deceleration of said roll, if any, means receiving said output signals from said line speed and rotational speed measuring means and from said acceleration or deceleration signal producing means and producing an output signal proportional to the energy in said roll, braking means for applying variable braking force to said roll, and brake control means receiving and combining of said output signals proportional to the roll diameter, desired web tension and the energy in said roll and producing an output signal to said braking means for causing said braking means to apply variable braking force to said roll substantially maintaining said predetermined tension in said web as it is being unwound during acceleration, deceleration and constant web speed conditions, wherein the improvement comprises:

said means for producing an output signal proportional to the energy in said roll includes, means receiving said output signal proportional to the diameter of said roll and producing an output signal proportional to the cube of the diameter of said roll;

means receiving said output signal proportional to the cube of the diameter and said output signal proportional to said acceleration or deceleration of said roll, if any, and for combining said signals proportional to the cube of the diameter and the acceleration or deceleration of said roll to produce an output signal proportional to the energy in said roll, said last named means including means for manual adjustment to modify said output signal thereof to correspond to the density and width of said roll.

2. Apparatus as defined in claim 1 including:

means for measuring the tension of said web downstream of said unwinding device and producing an output signal proportional to said measured web tension;

said brake control means receiving said output signal proportional to said measured tension and modifying said output signal to said braking means sufficiently to effect substantial compensation for any difference between said predetermined desired tension and said measured tension.

3. A method of controlling the braking action of a roll of web material supported for rotation on an unwinding device, comprising the steps of continuously measuring line speed and the rate of change thereof of said web downstream of said unwinding device;

providing an output signal proportional to said line speed;

continuously measuring rotational speed of said roll of web;

continuously calculating the diameter of said roll from said line speed and rotational speed measurements;

continuously calculating the cube of the diameter of said roll;

continuously multiplying said cubed diameter by a predetermined constant proportional to the density and width of said roll to obtain the inertia of said roll;

continuously calculating the accelration or deceleration or said roll, if any;

continuously multiplying said inertia by said acceleration or deceleration, if any, to obtain said energy in said roll;

continuously calculating the braking force needed to apply a predetermined tension to said web from said diameter and energy calculations; and applying said needed braking force to said roll.

4. A method as defined in claim 3 including the steps of:

measuring the tension in said web downstream of said roll;

comparing said measured tension to said predetermined tension;

modifying said needed braking force sufficiently to correct said calculated braking force to obtain said predetermined tension in said web.

5. A method as defined in claim 4 including the step of preventing the correction of said braking force if the difference between said predetermined tension and said measured tension is less than a predetermined value.

* * * * *